United States Patent [19]

Booth

[11] 3,998,161

[45] Dec. 21, 1976

[54] CARTRIDGE ADAPTER

[76] Inventor: Robert C. Booth, 22957 Sutro St., Hayward, Calif. 94541

[22] Filed: June 30, 1975

[21] Appl. No.: 591,836

[52] U.S. Cl. ..... 102/43 R; 102/38

[51] Int. Cl.[2] ..... F42B 5/26

[58] Field of Search ..... 42/77, 59; 102/41, 43 R, 102/43 F, 43 P, 38

[56] References Cited

UNITED STATES PATENTS

| | | | |
|---|---|---|---|
| 2,465,962 | 3/1949 | Allen et al. | 102/38 |
| 2,938,458 | 5/1960 | O'Brien | 102/43 R |

FOREIGN PATENTS OR APPLICATIONS

| | | | |
|---|---|---|---|
| 41,340 | 3/1910 | Austria | 42/77 |

*Primary Examiner*—Charles T. Jordan

*Attorney, Agent, or Firm*—Harris Zimmerman

[57] ABSTRACT

A device for adapting a cartridge having a bottleneck casing to be fired in a standard revolver includes a cylindrical sleeve received about the bottleneck portion to provide a smooth cylindrical exterior for the cartridge. The sleeve bore includes a tapered portion to impinge on the oblique portion of the bottleneck. The sleeve is retained by a press fit on the cartridge.

1 Claim, 5 Drawing Figures

CARTRIDGE ADAPTER

BACKGROUND OF THE INVENTION

It is well known in the field of firearms that the muzzle velocity and energy of a bullet is directly related to the powder charge which projects the bullet. To increase the powder mass in the casing, it is common to increase the casing diameter relative to the bullet size, to produce a bullet having a bottleneck configuration. In such manner it is possible, for example, to propel a 0.357 magnum bullet with a powder charge normally used in a 0.44 magnum cartridge.

This technique produces bottlenecked bullets which are useful in rifles and some forms of automatic weapons. However, the bottleneck cartridge is not suitable for use in a revolver, with requires a cylindrical cartridge to be seated properly in the standard chamber of the cylinder.

SUMMARY OF THE INVENTION

The present invention generally comprises a device for adapting a bottleneck cartridge to be used in a standard revolver cartridge. It comprises a generally cylindrical sleeve having an exterior diameter equal to the exterior diameter of the wide portion of the casing. The bore of the sleeve includes a tapered portion which is received about the obliquely tapering medial portion of the cartridge, and a smooth bore portion received about the narrow neck of the cartridge. The sleeve is press fit onto the bottleneck cartridge to produce a smooth cylindrical exterior configuration thereof, suitable for use in a standard chamber of a revolver cylinder.

THE DRAWING

DESCRIPTION OF THE PREFERRED EMBODIMENT

Figure 1:
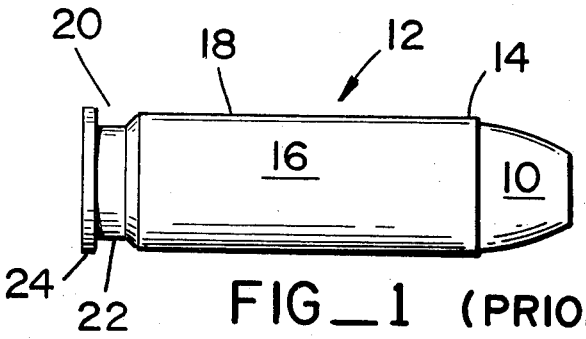
FIG 1 (PRIOR ART)
FIG. 1 is a side view of a standard cylindrical cartridge known in the prior art.

As shown in FIG. 1, a firearm cartridge 12 suitable for use in a revolver generally comprises a bullet 10 composed of lead or other heavy metal secured in the forward end 14 of a casing 16. The casing includes a cylindrical portion 18 extending from the bullet for substantially the entire length thereof. The rear 20 of the cartridge includes a reduced diameter neck 22 from which extends a radial flange or rim 24. It is the cylindrical portion 18 of the casing which allows the cartridge to be properly seated in a standard chamber of a revolver cylinder.

Figure 2:
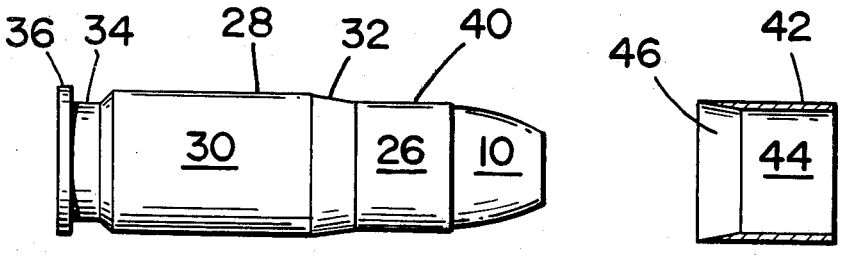
FIG. 2 is an exploded view of a bottleneck cartridge together with the adapter of the present invention.
Figure 3:
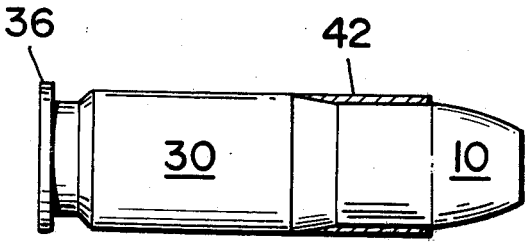
FIG. 3 is a partially sectioned view of the present invention assembled with a bottleneck cartridge.

A bottleneck cartridge 40, as shown in FIGS. 2 and 3, includes a similar bullet 10 secured in the forward end 26 of a casing 28. The casing 28 includes a rear portion 30 which is greater in diameter than the portion 26, to house an amount of powder greater than that in the standard casing 16. The diameter of the portion 26 is substantially equal to the rear diameter of the bullet. A tapering neck portion 32 joins the portions 30 and 26. The rear of casing portion 30 includes a reduced diameter neck 34 from which extends a radial flange or rim 36. The bottleneck cartridge 40 cannot be employed in a revolver, due to the fact that a revolver requires a bullet having a smooth cylindrical casing.

The present invention generally comprises a sleeve 42 adapted to be assembled with a bottleneck cartridge 40 to provide it with a smooth cylindrical exterior configuration such as would be suitable for use in a revolver. The sleeve is substantially equal in length to the combined length of portions 26 and 32 of a bottleneck bullet, and is adapted to be received thereon. The exterior diameter of the sleeve is equal to the diameter of the portion 30 of the cartridge.

The bore of the sleeve includes a cylindrical portion 44 having a diameter substantially equal to the portion 26 to provide a secure fit thereon. Extending rearwardly from the bore portion 44 is an outwardly flaring frusto-conical portion 46 which extends at an angle equal to the angle of the portion 32 of the cartridge which receives it. The flaring portion 46 aids in centering the sleeve on the cartridge 40.

Figure 4:
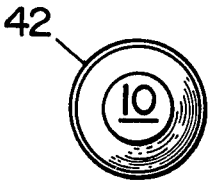
FIG. 4 is an end view of the adapter of the present invention assembled with a bottleneck cartridge.
Figure 5:
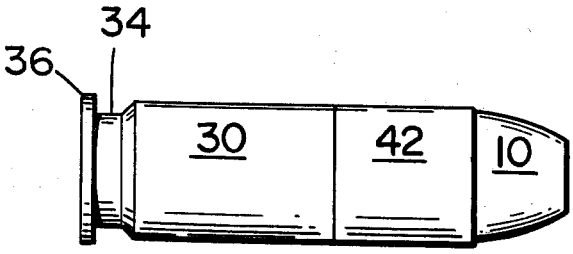
FIG. 5 is a side view of the adapter of the present invention assembled with a bottleneck cartridge.

The sleeve is pressed into place on the cartridge 40, and received as shown in FIGS. 3 and 4. The resulting cartridge assembly, shown in FIG. 5, achieves the smooth cylindrical configuration required for use in revolvers.

I claim:

1. In conjunction with a bottleneck cartridge having a major cylindrical portion, a tapered portion extending forward from said major cylindrical portion, a cylindrical neck portion extending forward from said tapered portion, and a projectile secured in the forward end of said neck portion, a device for adapting said bottleneck cartridge for use in a firearm requiring a smooth cylindrical cartridge, said device comprising a cylindrical sleeve adapted to be secured about said bottleneck cartridge, said sleeve having an outer diameter equal to the outer diameter of said major cylindrical portion of said bottleneck cartridge, said sleeve including a bore having a forward portion equal in diameter to the exterior diameter of said neck of said bottleneck cartridge and a rear flaring portion extending at an angle equal to said tapered portion of said bottleneck cartridge; said sleeve being equal in length to the combined lengths of said tapered portion and said neck portion of said bottleneck cartridge, and extending thereabout.

* * * * *